US008740215B2

(12) United States Patent
Watanabe et al.

(10) Patent No.: US 8,740,215 B2
(45) **Date of Patent: *Jun. 3, 2014**

(54) SHEET CONVEYING APPARATUS AND IMAGE FORMING APPARATUS

(71) Applicant: Canon Kabushiki Kaisha, Tokyo (JP)

(72) Inventors: Kenji Watanabe, Suntou-gun (JP); Yohei Suzuki, Suntou-gun (JP); Motohiro Furusawa, Suntou-gun (JP); Minoru Kawanishi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/845,428

(22) Filed: Mar. 18, 2013

(65) Prior Publication Data

US 2013/0214480 A1 Aug. 22, 2013

Related U.S. Application Data

(62) Division of application No. 13/410,495, filed on Mar. 2, 2012, now Pat. No. 8,439,358.

(30) Foreign Application Priority Data

Mar. 16, 2011 (JP) ..... 2011-058347

(51) Int. Cl.
*B65H 9/04* (2006.01)

(52) U.S. Cl.
USPC ..... 271/245; 271/246

(58) Field of Classification Search
USPC ..... 271/226, 243, 244, 245, 246
See application file for complete search history.

(56) References Cited

U.S. PATENT DOCUMENTS

| | | | | |
|---|---|---|---|---|
| 5,153,655 | A | 10/1992 | Suzuki et al. | |
| 5,157,444 | A | 10/1992 | Mori et al. | |
| 5,240,242 | A | 8/1993 | Ando et al. | |
| 6,011,948 | A | 1/2000 | Amano et al. | |
| 6,113,093 | A | 9/2000 | Morinaga et al. | |
| 6,385,406 | B1 | 5/2002 | Funamizu et al. | |
| 6,527,267 | B1 | 3/2003 | Kuwata et al. | |
| 6,830,245 | B2 | 12/2004 | Matsushima et al. | |
| 7,055,818 | B2 | 6/2006 | Furusawa | |
| 7,584,960 | B2 * | 9/2009 | Ha | 271/246 |
| 7,681,882 | B2 * | 3/2010 | Yu et al. | 271/243 |

(Continued)

FOREIGN PATENT DOCUMENTS

JP 9-183539 A 7/1997

*Primary Examiner* — Kaitlin Joerger

(74) *Attorney, Agent, or Firm* — Fitzpatrick, Cella, Harper & Scinto

(57) ABSTRACT

A sheet conveying apparatus, including: a first conveying portion; a second conveying portion arranged downstream of the first conveying portion; a shutter member rotated by the pressure of the sheet and including a plurality of abutment surfaces against which a leading edge of the sheet conveyed by the first conveying portion abuts to correct a skew feed of the sheet; and an urging portion which provides the shutter member with an urging force for positioning one abutment surface at an abutment position at which the leading edge of the sheet abuts against the one abutment surface, the urging portion providing the shutter member with an urging force for rotating the shutter member to position another abutment surface at the abutment position after the leading edge of the sheet is nipped by the second conveying portion.

6 Claims, 17 Drawing Sheets

(56) References Cited

U.S. PATENT DOCUMENTS

| | | | | |
|---|---|---|---|---|
| 7,703,757 | B2 | 4/2010 | Watanabe et al. | |
| 8,308,159 | B1 * | 11/2012 | Manor et al. | 271/245 |
| 8,342,519 | B2 * | 1/2013 | Watanabe et al. | 271/243 |
| 2009/0102117 | A1 * | 4/2009 | Yu et al. | 271/226 |
| 2010/0134552 | A1 | 6/2010 | Suzuki et al. | |
| 2012/0080838 | A1 | 4/2012 | Osada et al. | |
| 2012/0091652 | A1 | 4/2012 | Suzuki | |
| 2012/0093554 | A1 * | 4/2012 | Suzuki | 399/381 |

* cited by examiner

SHEET CONVEYING APPARATUS AND IMAGE FORMING APPARATUS

This application is a divisional of U.S. patent application Ser. No. 13/410,495, filed Mar. 2, 2012 and allowed on Jan. 22, 2013.

BACKGROUND OF THE INVENTION

1. Field of the Invention

The present invention relates to a sheet conveying apparatus and an image forming apparatus including the same, and more particularly, to a sheet conveying apparatus which corrects the skew feed of a conveying sheet.

2. Description of the Related Art

Generally, in an image forming apparatus, the precision of a recording position (hereinafter, also referred to as "recording precision") of an image with respect to a sheet is one of the important factors from the viewpoint of keeping the image quality. Therefore, for example, when a conveying sheet is skewed during image formation, it is necessary to correct the skewed sheet to an appropriate sheet position. In view of this, in conventional image forming apparatus, there have been proposed various sheet conveying apparatus having a skew feed correction function so as to enhance the recording precision (see Japanese Patent Application Laid-Open No. H09-183539).

For example, in the sheet conveying apparatus described in Japanese Patent Application Laid-Open No. H09-183539, a plurality of conveying roller pairs are provided in a sheet width direction orthogonal to a sheet conveying direction, and a shutter member rotatable about a rotary shaft of the conveying rollers is arranged between the conveying roller pairs. The shutter member has an abutment portion against which a sheet abuts. When the leading edge of a sheet abuts against the abutment portion, the sheet slacks due to the reaction force from the abutment portion to form a bent loop. The formation of the loop aligns the leading edge of the sheet in parallel to the sheet width direction orthogonal to the conveying direction to correct a skew feed. Then, when the shutter member is rotated, the leading edge of the sheet is nipped by a nip portion of the conveying roller pairs while being aligned in parallel to the sheet width direction, and thus the sheet is conveyed. That is, the sheet is conveyed with the skew feed thereof being corrected. By the way, in recent years, the following has been required for an image forming apparatus: further enhancement of a throughput; increase of a conveying speed of a sheet; and decrease of a distance from a trailing edge of a preceding sheet to a leading edge of a succeeding sheet (hereinafter, referred to as "sheet-to-sheet distance"). Therefore, after the preceding sheet has passed, the shutter member needs to be returned to a home position (a position in which the leading edge of the skewed sheet abuts against the abutment portion to correct a skew feed) in the shortened sheet-to-sheet distance.

Here, FIGS. 17 to 18B illustrate a shutter member 423 provided in the conventional sheet conveying apparatus. As illustrated in FIG. 17, the conventional shutter member 423 is supported rotatably by a rotary shaft 418*a* of conveying rollers 418 of conveying roller pairs 418, 419. As illustrated in FIGS. 18A and 18B, the shutter member 423 guides a sheet S of which a skew feed is corrected, to a nip portion of the conveying roller pairs 418, 419. After that, the shutter member 423 performs reciprocating rotation so as to pass through the nip portion again, to thereby return to the abutment position. Therefore, the minimum required sheet-to-sheet distance is a total distance of a distance D1 from a position where the trailing edge of the preceding sheet S passes by an abutment surface of the shutter member 423 to a home position where the sheet S is subjected to skew feed correction, and a distance D2 in which, during this time, the succeeding sheet S is conveyed to the home position.

Because the shutter member 423 performs reciprocating rotation so as to pass through the nip portion of the conveying roller pairs 418, 419, the distance D1 is necessarily generated, and the shutter member 423 takes a time ΔT for moving the distance D1. On the other hand, the distance D2 is a distance (ΔT×V) obtained by multiplying the time ΔT during which the shutter member 423 moves the distance D1 by a conveying speed V of the sheet S. As the conveying speed of the sheet S becomes higher, the distance becomes longer. Therefore, when the conveying speed of the sheet S is increased in the conventional sheet conveying apparatus, the sheet-to-sheet distance becomes longer, which prevents the further enhancement of a throughput.

SUMMARY OF THE INVENTION

It is an object of the present invention to provide a sheet conveying apparatus which prevents a sheet-to-sheet distance from becoming longer and enhances a throughput, even in a case where a sheet conveying speed is increased, and to provide an image forming apparatus including the sheet conveying apparatus.

The present invention provides a sheet conveying apparatus, including: a first conveying portion which conveys a sheet; a second conveying portion which nips and conveys the sheet, the second conveying portion being arranged downstream of the first conveying portion in a sheet conveying direction; a shutter member including a plurality of abutment surfaces against which a leading edge of the sheet conveyed by the first conveying portion abuts to correct a skew feed of the sheet, the plurality of abutment surfaces being formed in a peripheral direction of the shutter member, the shutter member being pressed by the conveyed sheet to rotate; and an urging portion which provides the shutter member with an urging force for positioning one abutment surface of the plurality of abutment surfaces at an abutment position at which the leading edge of the sheet conveyed by the first conveying portion abuts against the one abutment surface of the shutter member, wherein the urging portion includes: a first rotary member connected to a rotary shaft of the shutter member; a second rotary member connected to the first rotary member so as to rotate at a speed ratio of the second rotary member to the first rotary member when the first rotary member rotates, wherein the speed ratio is the same number as a number of the plurality of abutment surfaces; and an urging spring connected to the second rotary member, the urging spring urging the second rotary member so as to generate a reaction force exerted on the sheet when the shutter member is pressed by the sheet conveyed by the first conveying portion to rotate in a rotation direction, and the urging spring switching a direction of an urging force exerted on the second rotary member to a direction of rotating the shutter member in the rotation direction after the leading edge of the sheet is nipped by the second conveying portion while rotating the shutter member, to position another abutment surface against which a succeeding sheet abuts at the abutment position.

According to the present invention, a time period required for the shutter member to be positioned to the home position after the passage of the sheet can be shortened, it is not necessary to keep a distance required as a sheet-to-sheet distance to be large, and a throughput can be enhanced.

Further features of the present invention will become apparent from the following description of exemplary embodiments with reference to the attached drawings.

DESCRIPTION OF THE EMBODIMENTS

Hereinafter, an image forming apparatus including a sheet conveying portion according to embodiments of the present invention will be described with reference to the drawings. The image forming apparatus according to the embodiments of the present invention is an image forming apparatus having a skew feed correction function which corrects the skew feed of a sheet to be conveyed, such as a copier, a printer, a facsimile machine, and composite equipment thereof. In the following embodiments, the image forming apparatus will be described, taking an electrophotographic color image forming apparatus (hereinafter, referred to as "image forming apparatus") 100 which forms toner images of four colors as an example.

First Embodiment

Figure 1:
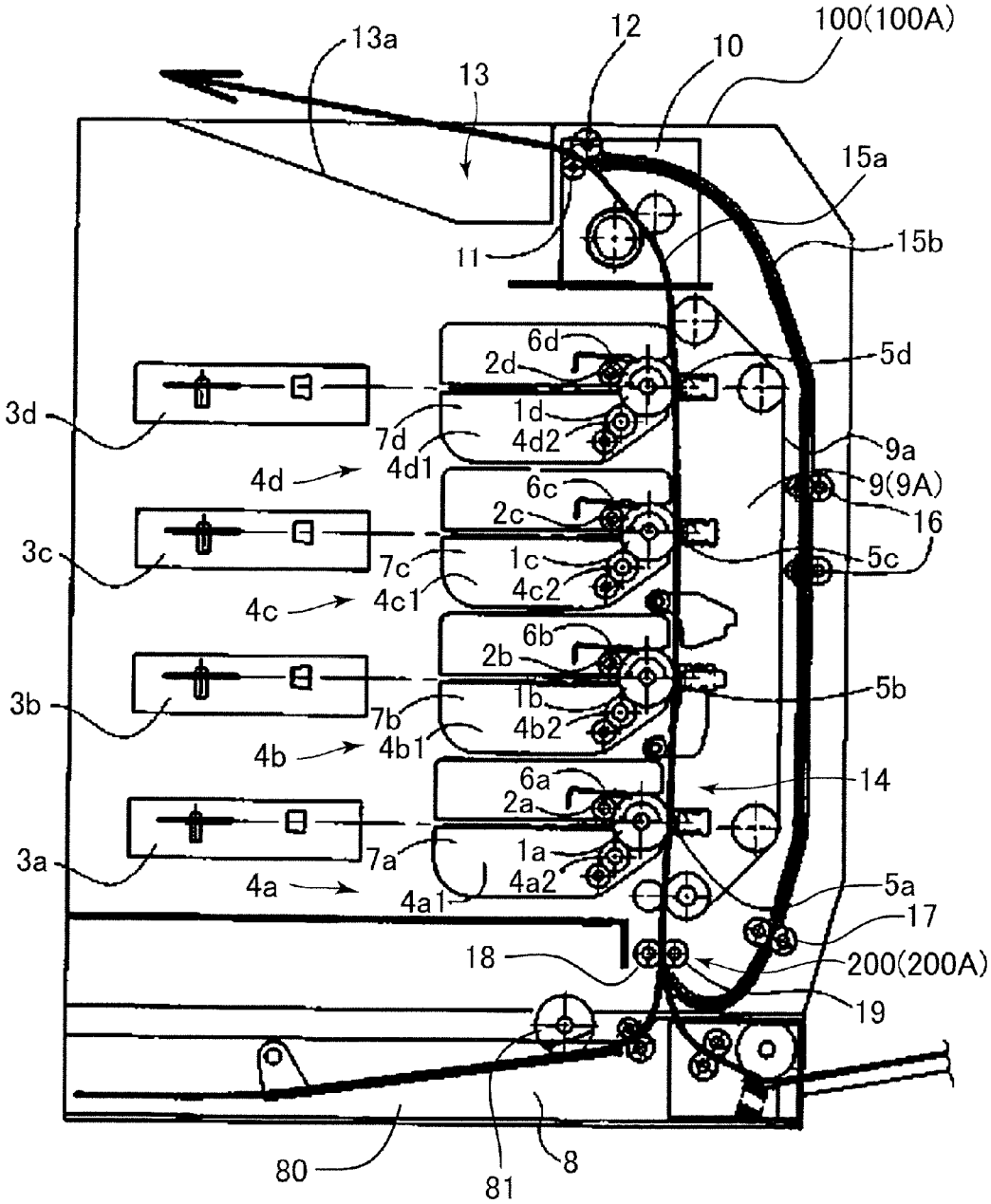
FIG. 1 is a cross-sectional view schematically illustrating an entire structure of an image forming apparatus according to a first embodiment of the present invention.

The image forming apparatus 100 according to a first embodiment of the present invention will be described with reference to FIGS. 1 to 13. First, an entire structure of the image forming apparatus 100 according to the first embodiment will be described with reference to FIG. 1. FIG. 1 is a cross-sectional view schematically illustrating the entire structure of the image forming apparatus 100 according to the first embodiment of the present invention.

As illustrated in FIG. 1, the image forming apparatus 100 according to the first embodiment includes a sheet feeding portion 8 which feeds sheets S, an image forming portion 14 which forms a toner image, a fixing portion 10 for fixing the transferred, unfixed toner image, and a sheet conveying portion 9 serving as a sheet conveying apparatus. The image forming apparatus 100 further includes a sheet discharge portion 13 which discharges the sheets S on each of which the toner image is fixed.

The sheet feeding portion 8 includes a feed cassette 80 in which the sheets S are stored, a feed roller 81 which feeds the sheets S stored in the feed cassette 80 to the sheet conveying portion 9, and a separation portion (not shown) for separating the sheets S one by one. The sheet feeding portion 8 feeds the sheets S stored in the feed cassette 80 to the sheet conveying portion 9 by the feed roller 81 while separating the sheets S one by one in the separation portion.

The image forming portion 14 forms the toner image based on predetermined image information, and transfers the toner image onto the sheet S conveyed by the sheet conveying portion 9. The image forming portion 14 includes photosensitive drums 1*a*, 1*b*, 1*c*, and 1*d*, charging portions 2*a*, 2*b*, 2*c*, and 2*d*, exposure portions 3*a*, 3*b*, 3*c*, and 3*d*, developing portions 4*a*, 4*b*, 4*c*, and 4*d*, transfer rollers 5*a*, 5*b*, 5*c*, and 5*d*, and cleaning portions 6*a*, 6*b*, 6*c*, and 6*d*. The image forming portion 14 further includes a transfer belt 9*a*.

The photosensitive drums 1*a* to 1*d* serving as image bearing members are each formed by coating the outer circumferential surface of an aluminum cylinder with an organic photoconductor (OPC) layer. Both ends of each of the photosensitive drums 1*a* to 1*d* are supported by flanges so as to be rotatable. A drive force is transmitted to one end of each of the photosensitive drums 1*a* to 1*d* from a drive motor (not shown), whereby the photosensitive drums 1*a* to 1*d* are driven to be rotated counterclockwise in FIG. 1. The charging portions 2*a* to 2*d* respectively allow electroconductive rollers formed into a roller shape to abut against the surfaces of the photosensitive drums 1*a* to 1*d*. A charging bias voltage is applied to the charging portions 2*a* to 2*d* through a power supply (not shown), to thereby uniformly charge the surfaces of the photosensitive drums 1*a* to 1*d*, respectively. The exposure portions 3*a* to 3*d* respectively irradiate the photosensitive drums 1*a* to 1*d* with a laser beam based on image information to form electrostatic latent images on the photosensitive drums 1*a* to 1*d*, respectively.

The developing portions 4*a* to 4*d* respectively include toner containing portions 4*a*1, 4*b*1, 4*c*1, and 4*d*1, and developing roller portions 4*a*2, 4*b*2, 4*c*2, and 4*d*2. The toner containing portions 4*a*1 to 4*d*1 contain toner of respective colors: black, cyan, magenta, and yellow. The developing roller portions 4*a*2 to 4*d*2 are respectively arranged adjacent to the surfaces of photosensitive bodies. A developing bias voltage is applied to the developing roller portions 4*a*2 to 4*d*2 to thus allow toner of respective colors to adhere to the electrostatic latent images on the photosensitive drums 1*a* to 1*d*, thereby visualizing the electrostatic latent images as toner images.

The transfer rollers 5*a* to 5*d* are arranged inside the transfer belt 9*a* so as to be respectively opposed to the photosensitive drums 1*a* to 1*d* and abut against the transfer belt 9*a*. The transfer rollers 5*a* to 5*d* are each connected to a transfer bias power supply (not shown), and the transfer rollers 5*a* to 5*d* apply positive charges to the sheet S through the transfer belt 9*a*. The electric field enables the negative toner images of the respective colors on the photosensitive drums 1*a* to 1*d* to be transferred successively to the sheet S that is brought into contact with the photosensitive drums 1*a* to 1*d*, whereby a color image is formed. The cleaning portions 6*a* to 6*d* respectively remove toner remaining on the surfaces of the photosensitive drums 1*a* to 1*d* after the transfer. In this embodiment, the photosensitive drums 1*a* to 1*d*, the charging portions 2*a* to 2*d*, the developing portions 4*a* to 4*d*, and the cleaning portions 6*a* to 6*d* integrally form process cartridge portions 7*a* to 7*d*, respectively.

The fixing portion 10 heats the sheet S with an unfixed toner image transferred thereto to fix the unfixed toner image. The sheet delivery portion 13 includes a delivery roller pair 11, 12 which rotates forward to convey the sheet S with an image formed thereon and which rotates reversely to reverse the sheet S, and a delivery portion 13*a* into which the sheet S with an image formed thereon is delivered.

The sheet conveying portion 9 conveys the sheet S with the toner image formed in the image forming portion 14 thereon. The sheet conveying portion 9 includes a sheet conveying path 15*a*, a duplex conveying path 15*b*, an oblique-feed roller pair 16, a U-turn roller pair 17 serving as a first conveying portion, a plurality of roller pairs 18, 19 serving as a second conveying portion, and a skew feed correcting portion 200.

The sheet conveying path 15*a* is a conveying path which conveys the sheet S fed from the sheet feeding portion 8 or the sheet S conveyed from the duplex conveying path 15*b*, and the toner image formed in the image forming portion 14 is transferred at a predetermined position of the sheet conveying path 15*a*. The duplex conveying path 15*b* is a conveying path which conveys, to the sheet conveying path 15*a*, the sheet S reversed by the delivery roller pair 11, 12 so as to perform double-sided printing. The oblique-feed roller pair 16 is arranged in the duplex conveying path 15*b* and conveys the reversed sheet S. The U-turn roller pair 17 is arranged in the duplex conveying path 15*b* and reconveys the sheet S being conveyed in the duplex conveying path 15*b* to the sheet conveying path 15*a*.

The plurality of roller pairs 18, 19 are arranged downstream of the skew feed correcting portion 200, and includes a plurality of conveying rollers 19 and a plurality of conveying rotatable members 18 arranged so as to be held in pressure-contact with the plurality of conveying rollers 19 respectively. The conveying rollers are fixed to a rotary shaft 19*a* that is axially supported in parallel to rotary shafts (not shown) of the photosensitive drums 1*a* to 1*d* (see FIG. 1), and rotate integrally with the rotary shaft 19*a*. The conveying rotatable members 18 are axially and rotatably supported by a feed frame 20 (described later) so that the rotation center of the conveying rotatable members 18 is substantially the same as the center of a shutter shaft 22 that is axially supported in parallel to the rotary shafts of the photosensitive drums 1*a* to 1*d*. Further, the conveying rotatable members 18 are brought into pressure-contact with the conveying rollers 19 by conveying rotatable member springs 21 fixed to the feed frame 20, and are brought into pressure-contact with the conveying rollers 19 with a pressure-contact force of the conveying rotatable member springs 21 to thereby form driven rotary members of the conveying rollers 19 which conveys the sheet S. Note that, there is a gap between the inner circumferential surface of the conveying rotatable members and the outer circumferential surface of the shutter shaft 22 (shutter shaft 22 is inserted inside the inner circumferential surface of the conveying rotatable members 18), and hence a spring force of the conveying rotatable member springs 21 is not transmitted to the shutter shaft 22. Therefore, the spring force of the conveying rotatable member springs 21 does not inhibit the rotation of a plurality of shutter members 23 fixed to the shutter shaft 22.

The skew feed correcting portion 200 is provided in the sheet conveying path 15*a* and forms a loop in the sheet S fed from the sheet feeding portion 8 or the sheet S conveyed from the duplex conveying path 15*b*, thereby correcting the skew feed of the sheet S. The skew feed correcting portion 200 will be described later in detail.

The sheet S fed from the sheet feeding portion 8 to the sheet conveying path 15*a* is conveyed to the image forming portion 14 through the skew feed correcting portion 200, and the toner images of the respective colors are transferred onto the sheet S successively in the image forming portion 14. Then, the unfixed toner image is fixed onto the sheet S in the fixing portion 10, and the sheet S is delivered to the sheet delivery portion 13 by the delivery roller pair 11, 12.

Further, in a case of double-sided printing, after the unfixed toner image is fixed onto the sheet S in the fixing portion 10, the delivery roller pair 11, 12 is rotated reversely before the sheet S is delivered to the sheet delivery portion 13 by the delivery roller pair 11, 12. Thus, the sheet S having one surface with a toner image fixed thereto is conveyed to the duplex conveying path 15*b* while being reversed. The sheet S conveyed to the duplex conveying path 15*b* forms a loop in the skew feed correcting portion 200 through the oblique-feed roller pair 16 and the U-turn roller pair 17 so that a skew feed of the sheet S is corrected. Then, the sheet S is reconveyed to the image forming portion to be subjected to double-sided printing.

Figure 2A:
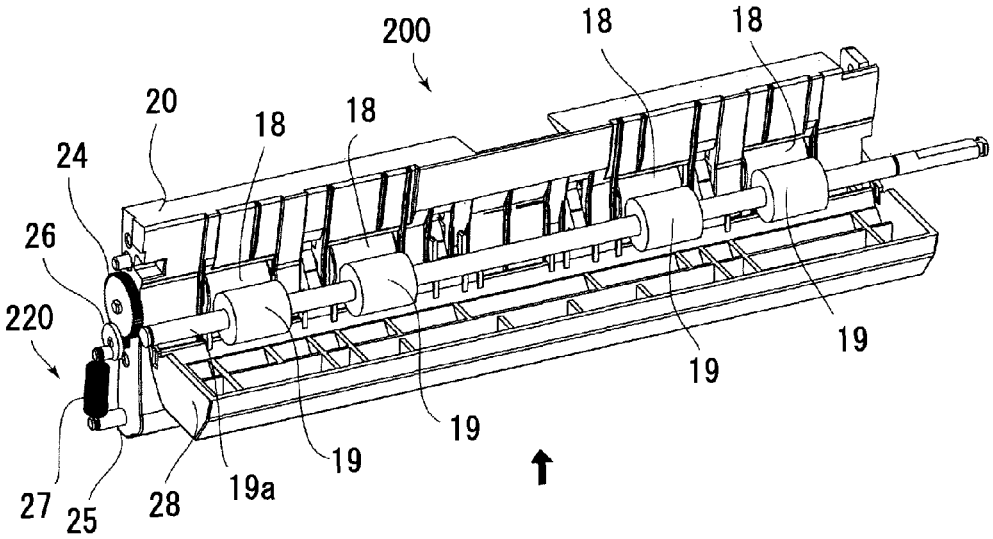
FIG. 2A is a perspective view of a skew feed correcting portion according to the first embodiment.
Figure 2B:
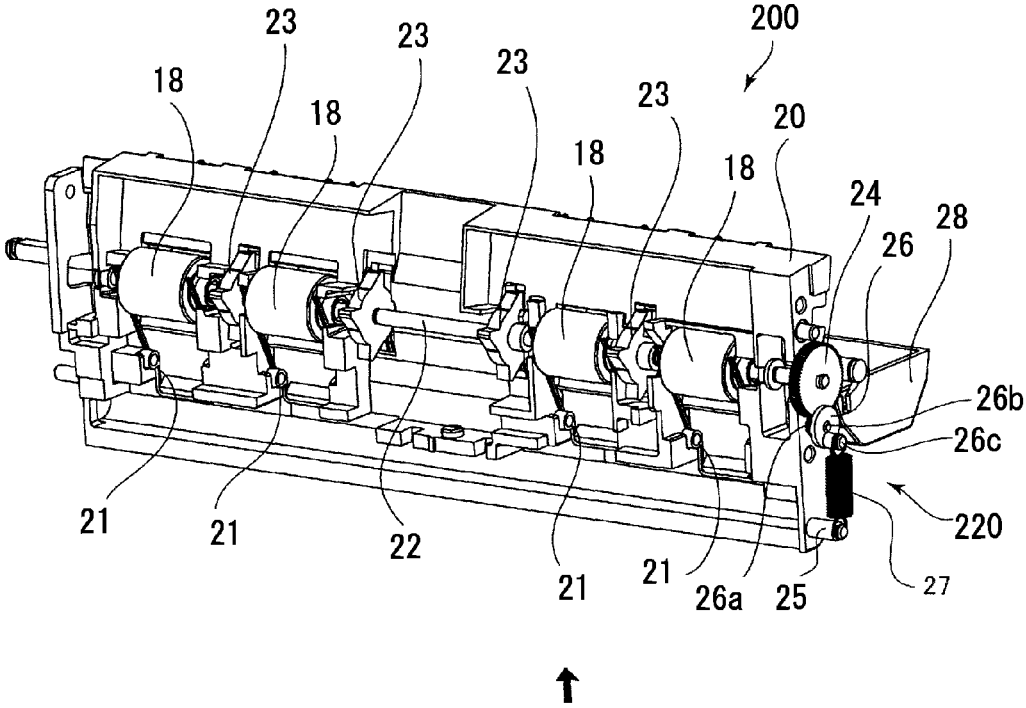
FIG. 2B is a perspective view of the skew feed correcting portion illustrated in FIG. 2A, when viewed from an opposite side of FIG. 2A.
Figure 3:
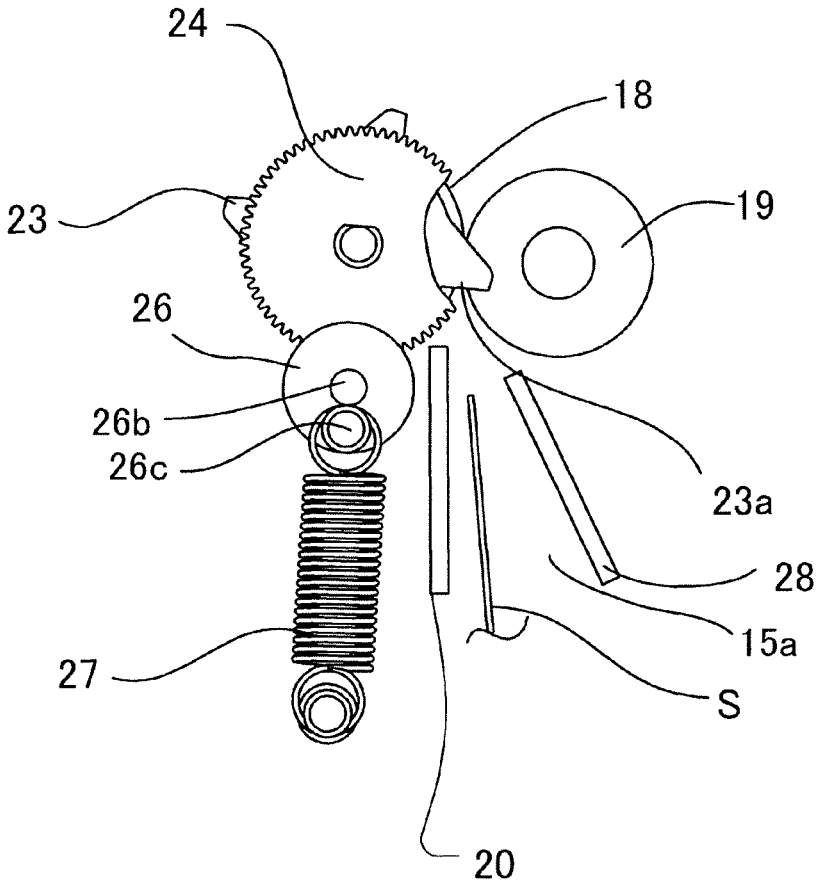
FIG. 3 is a view illustrating a state in which a sheet is conveyed to the skew feed correcting portion according to the first embodiment.

Next, the skew feed correcting portion 200 for correcting the skew feed of the sheet S will be described specifically with reference to FIG. 1 as well as FIGS. 2A to 11. First, an entire configuration of the skew feed correcting portion 200 will be described with reference to FIGS. 1 to 3. FIG. 2A is a perspective view of the skew feed correcting portion 200 according to the first embodiment. FIG. 2B is a perspective view of the skew feed correcting portion 200 illustrated in FIG. 2A, when viewed from an opposite side of FIG. 2A. FIG. 3 illustrates a state in which the sheet S is conveyed to the skew feed correcting portion 200 according to the first embodiment. Arrows illustrated in FIGS. 2A and 2B indicate a conveying direction of the sheet S.

As illustrated in FIGS. 2A and 2B, the skew feed correcting portion 200 includes the feed frame 20, a guide frame 28, the plurality of shutter members 23, and an urging portion 220. As illustrated in FIG. 3, the feed frame 20 and the guide frame 28 regulate both sides in the thickness direction of the sheet S upstream of the shutter member 23, and guide the sheet S being conveyed in the sheet conveying path 15*a* toward the conveying roller pairs 18, 19 (see FIG. 1). Further, the feed frame 20 and the guide frame 28 include a loop forming portion 32 (see FIG. 6 described later) that is arranged at predetermined distances apart from the feed frame 20 and the guide frame so that the sheet S can form a loop curved in the thickness direction of the sheet S after the sheet S abuts against an abutment surface 23*a* (described later). The sheet S conveyed to the skew feed correcting portion 200 forms a loop in the loop forming portion 32, to correct the skew feed of the sheet S.

As illustrated in FIG. 2B, the plurality of shutter members 23 are fixed to the shutter shaft 22 supported rotatably by the feed frame 20. The shutter members 23 are each provided with four abutment surfaces 23*a* to 23*d* in the peripheral direction of the shutter members 23. The four abutment surfaces 23*a* to 23*d* abut against the leading edge of the sheet S before the sheet S enters a nip portion N between the conveying roller 19 and the conveying rotatable member 18, thereby locking the sheet S and correcting the skew feed of the sheet S (see FIGS. 9 and 10 described later). Therefore, the four abutment surfaces 23*a* to 23*d* are arranged so that a corresponding one of the abutment surfaces 23*a* to 23*d* is positioned upstream of the nip portion N between the conveying roller 19 and the conveying rotatable member 18 immediately before the leading edge of the sheet S abuts against the corresponding one of the abutment surfaces 23*a* to 23*d*.

The urging portion 220 includes a shutter gear 24 serving as a first rotary member, a shutter drive member 26 serving as a second rotary member provided with a gear 26*a* to be engaged with the shutter gear 24, and a shutter spring 27 serving as an urging spring.

The shutter gear 24 is fixed to an end of the shutter shaft 22. The shutter drive member 26 is rotatably supported by a shaft 26*b* provided on the feed frame 20, and a connecting portion 26*c* is provided at a position decentered from the rotation center of the shaft 26*b*. Further, the shutter drive member 26 is connected to the shutter gear 24 through the gear 26*a*, and in this embodiment, a gear ratio between the shutter gear 24 and the gear 26*a* of the shutter drive member 26 is 4:1. That is, four turns of the shutter drive member 26 causes one turn of the shutter gear 24. In other words, a ¼ turn of the shutter gear 24 causes one turn of the shutter drive member 26 (of which a rotation angle is large). As described above, the gear ratio (speed ratio) between the shutter gear 24 and the second gear 26*a* is set to be the same number of teeth (integer ratio) as the number of the abutment surfaces of each of the shutter members 23. In this embodiment, the speed ratio of the second gear 26*a* to the shutter gear 24 when the shutter gear 24 rotates is 4 as the same number of the abutment surfaces of each of the shutter members 23. Accordingly, the shutter drive member 26 makes one turn due to a switching operation of the four abutment surfaces 23*a* to 23*d* arranged in the peripheral direction.

The shutter spring 27 is connected to the connecting portion 26*c* of the shutter drive member 26 with use of a spring stretching portion 25 formed on the feed frame 20 as a fixed end. That is, one end of the shutter spring 27 is positionally-fixed to the spring stretching portion 25, and the other end thereof is connected to the connecting portion 26*c*. The shutter spring 27 is connected to the shutter drive member 26 so that an urging force of the shutter spring 27 is in balance (in a state in which a spring length of the shutter spring becomes shortest) when the abutment surface is at an abutment position where the shutter member 23 abuts against the leading edge of the sheet S. That is, the connecting portion 26*c* of the shutter drive member 26 becomes a bottom dead center under a state that the shutter spring 27 is in balance. On the other hand, the shutter spring 27 is configured so as to stretch and contract according to the position of the connecting portion 26*c* when the shutter drive member 26 rotates, and the connecting portion 26*c* is positioned at a top dead center in the middle of the rotation.

Figure 4:
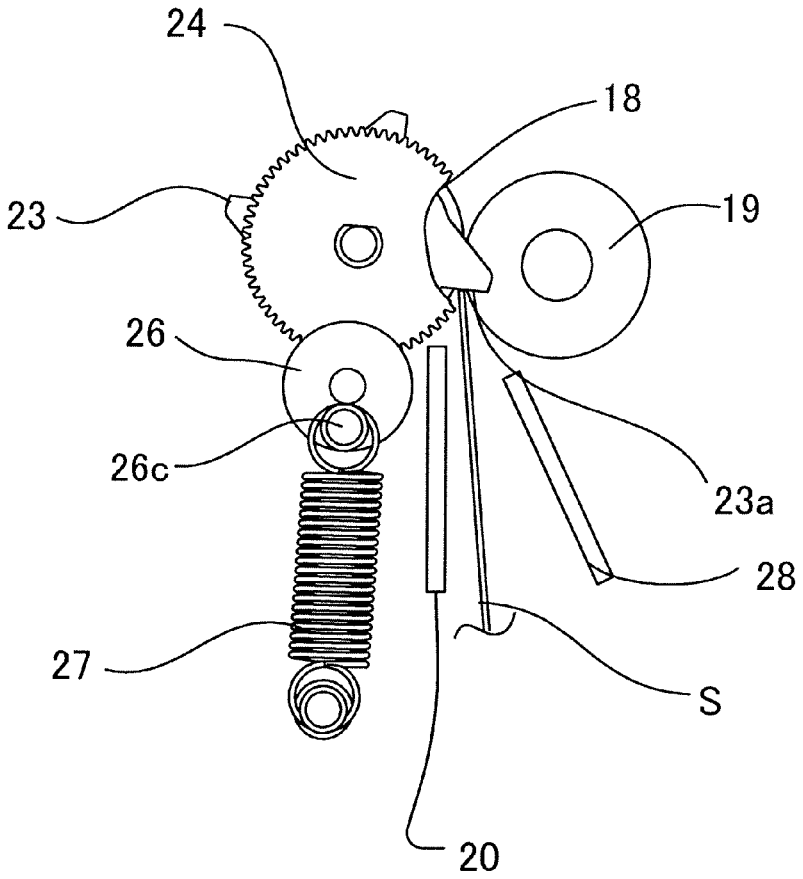
FIG. 4 is a view illustrating a state in which a leading edge of the sheet abuts against an abutment surface of a shutter member of the skew feed correcting portion illustrated in FIG. 3.
Figure 5:
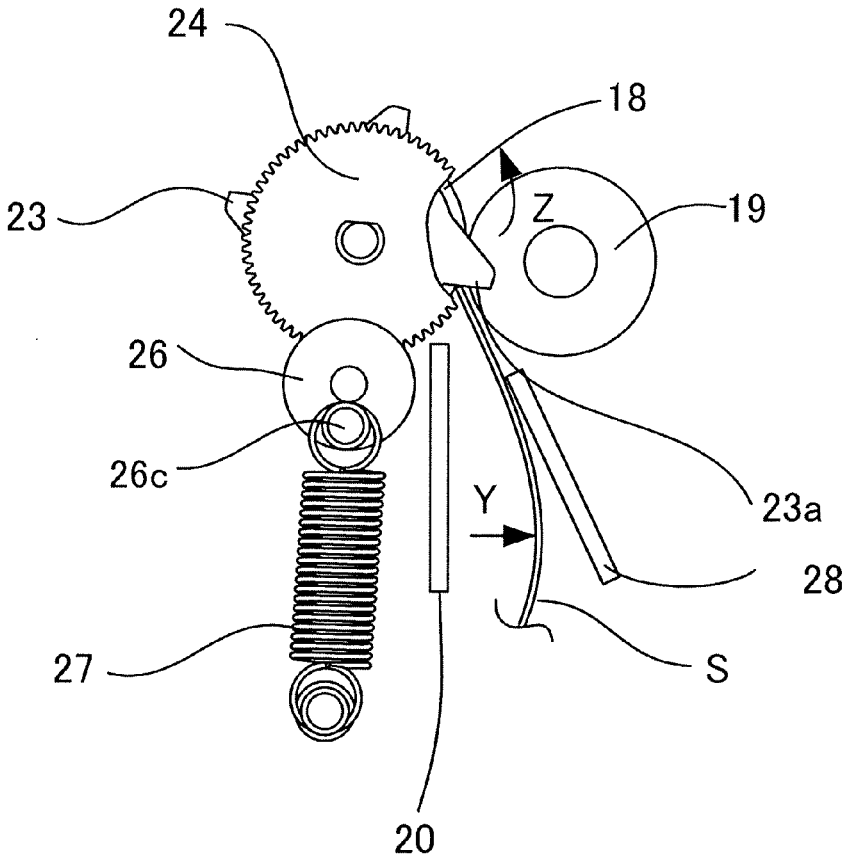
FIG. 5 is a view illustrating a state in which the leading edge of the sheet abuts against the abutment surface of the shutter member illustrated in FIG. 4 so that the sheet is bent.
Figure 6:
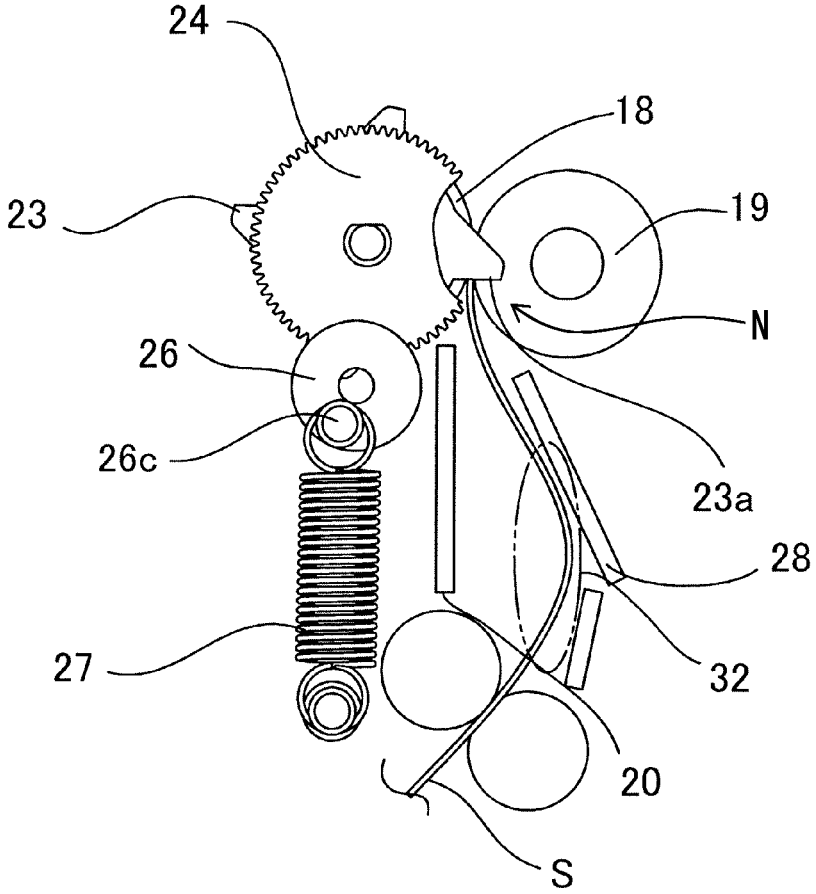
FIG. 6 is a view illustrating a state in which the leading edge of the sheet abuts against the abutment surface of the shutter member illustrated in FIG. 5 so that the sheet forms a loop.
Figure 7:
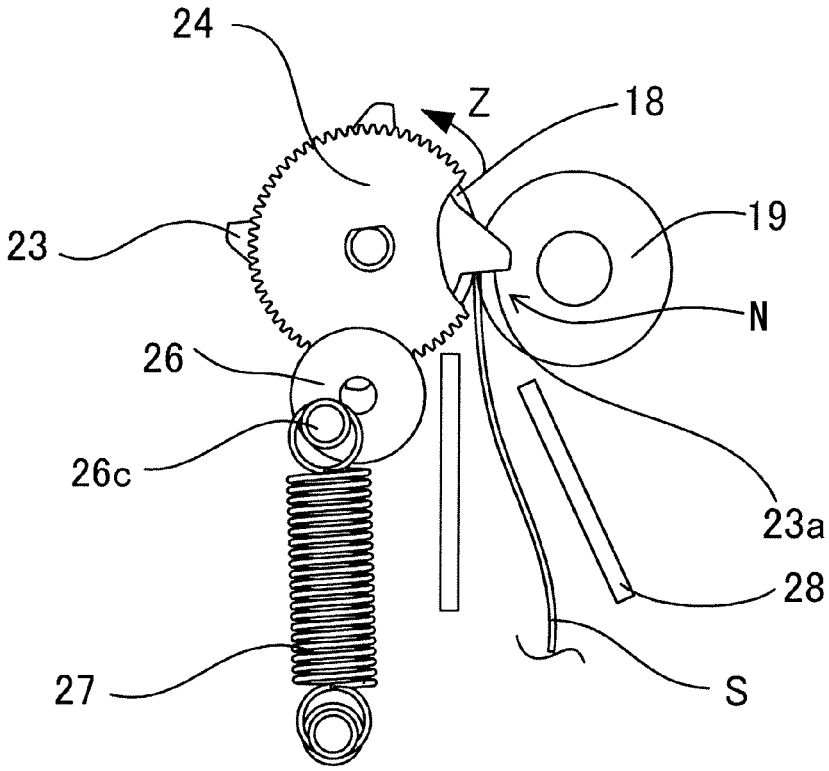
FIG. 7 is a view illustrating a state in which the leading edge of the sheet presses the abutment surface of the shutter member illustrated in FIG. 6 to rotate the shutter member.
Figure 8:
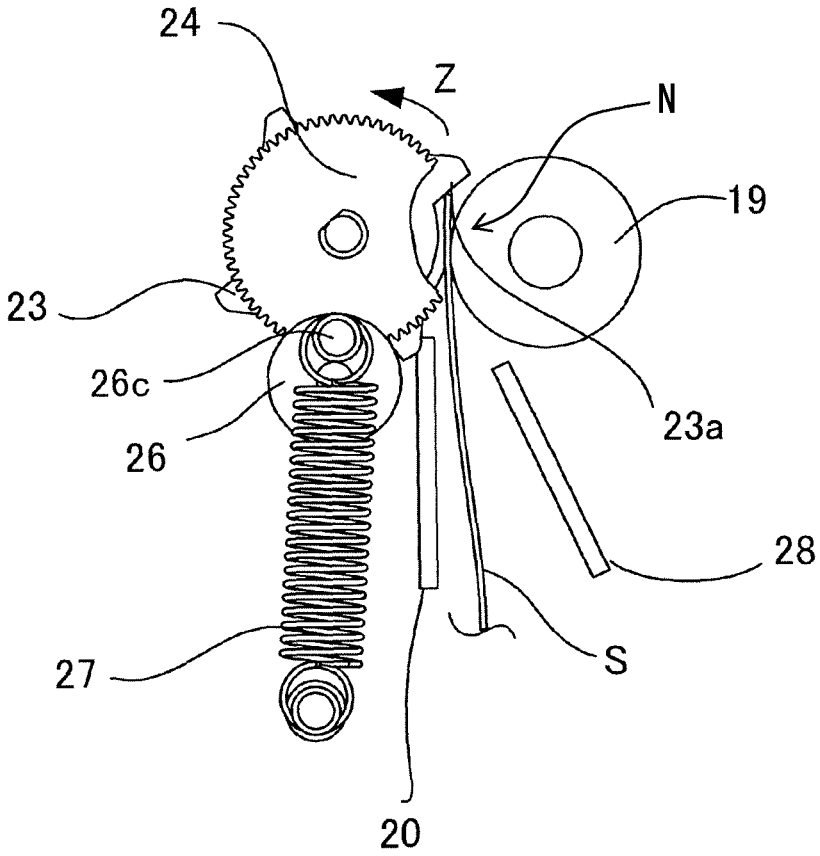
FIG. 8 is a view illustrating a state in which the shutter member illustrated in FIG. 7 rotates further so that the sheet is nipped by a roller pair.

Next, an operation of the skew feed correcting portion 200 will be described with reference to FIGS. 1 and 3, as well as FIGS. 4 to 12. FIG. 4 illustrates a state in which the leading edge of the sheet S abuts against the abutment surface 23*a* of the shutter member 23 of the skew feed correcting portion 200 illustrated in FIG. 3. FIG. 5 illustrates a state in which the leading edge of the sheet S abuts against the abutment surface 23*a* of the shutter member 23 illustrated in FIG. 4 so that the sheet S is bent. FIG. 6 illustrates a state in which the leading edge of the sheet S abuts against the abutment surface 23*a* of the shutter member 23 illustrated in FIG. 5 so that the sheet S forms a loop. FIG. 7 illustrates a state in which the leading edge of the sheet S presses the abutment surface 23*a* of the shutter member 23 illustrated in FIG. 6 to rotate the shutter member 23. FIG. 8 illustrates a state in which the shutter member 23 illustrated in FIG. 7 further rotates so that the sheet S is nipped by the conveying roller pair 18, 19.

Figure 9:
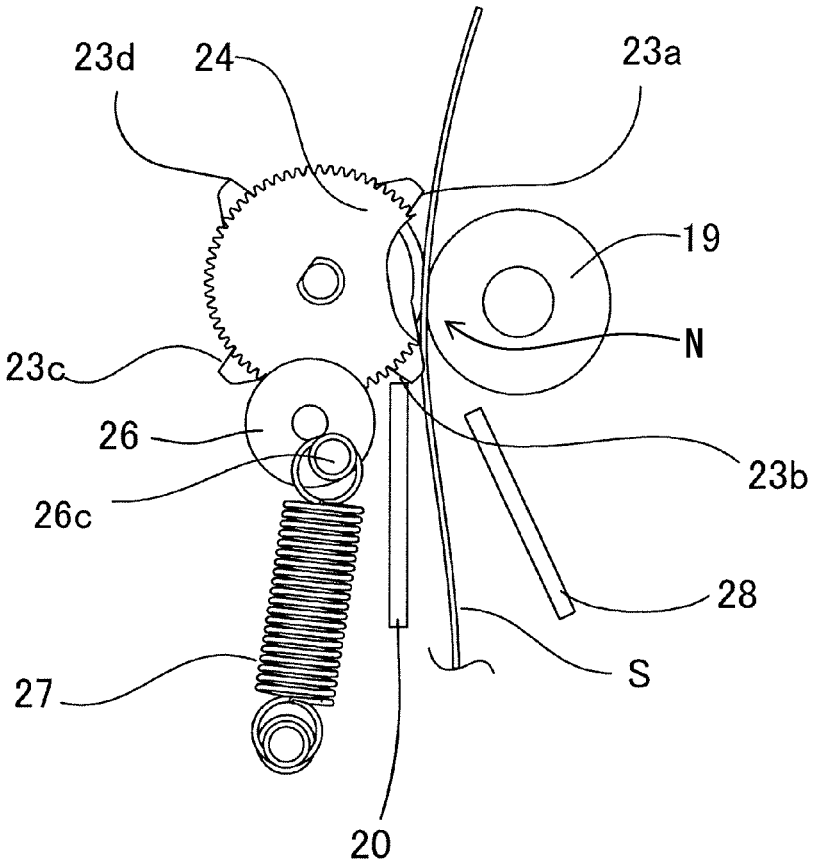
FIG. 9 is a view illustrating a state in which the shutter member illustrated in FIG. 8 rotates so that a first abutment surface retracts from a sheet conveying path and a second abutment surface stands by at a standby position.
Figure 10:
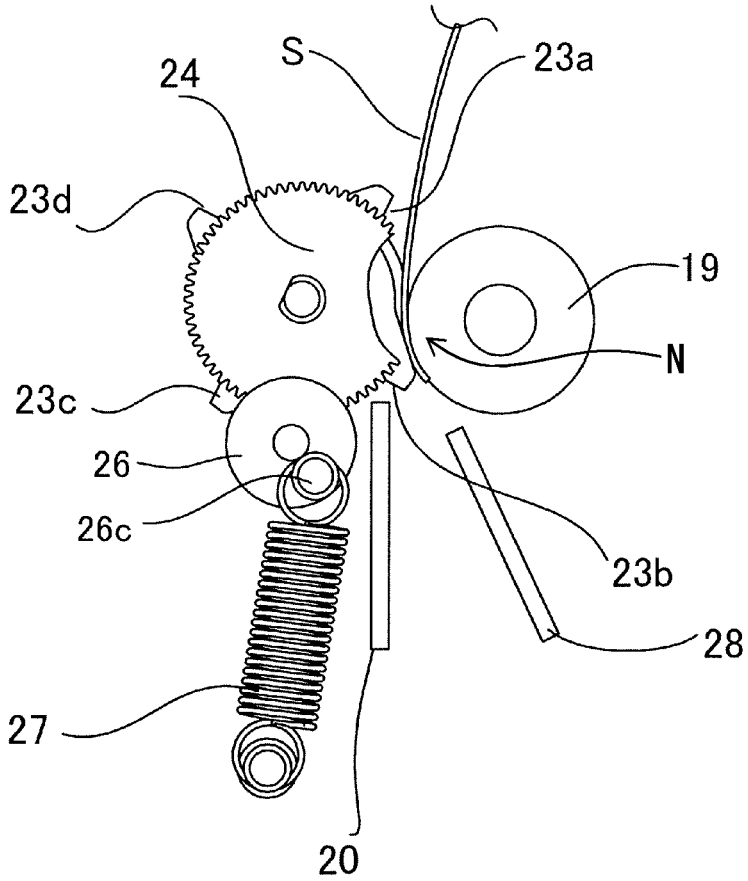
FIG. 10 is a view illustrating a state in which the sheet nipped by the roller pair passes through a nip portion between the roller pair.
Figure 11:
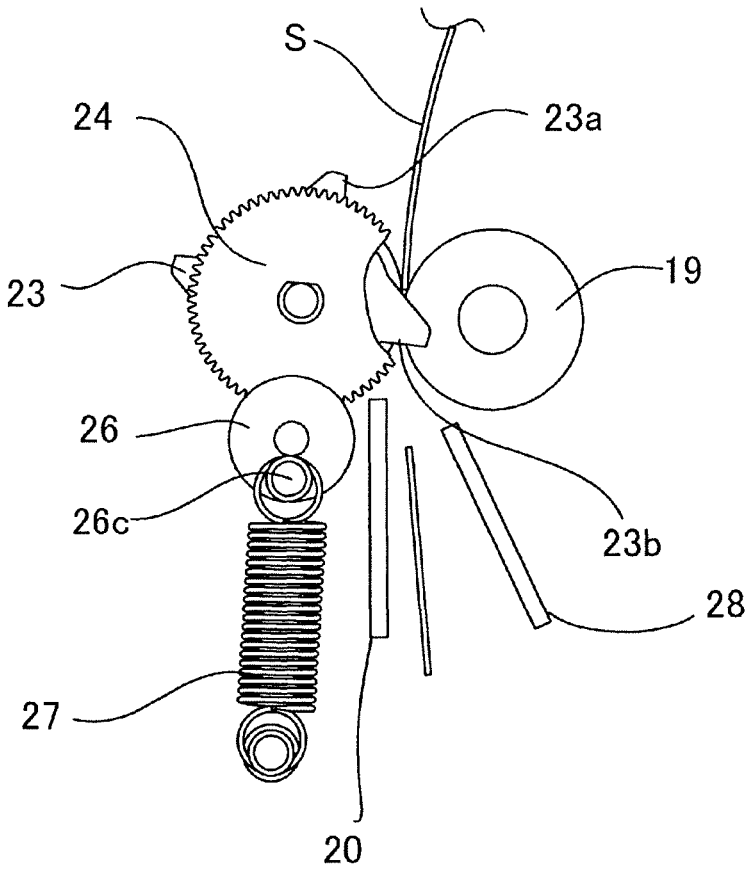
FIG. 11 is a view illustrating a state in which the sheet nipped by the roller pair passes through the nip portion and the second abutment surface is positioned at a home position.
Figure 12:
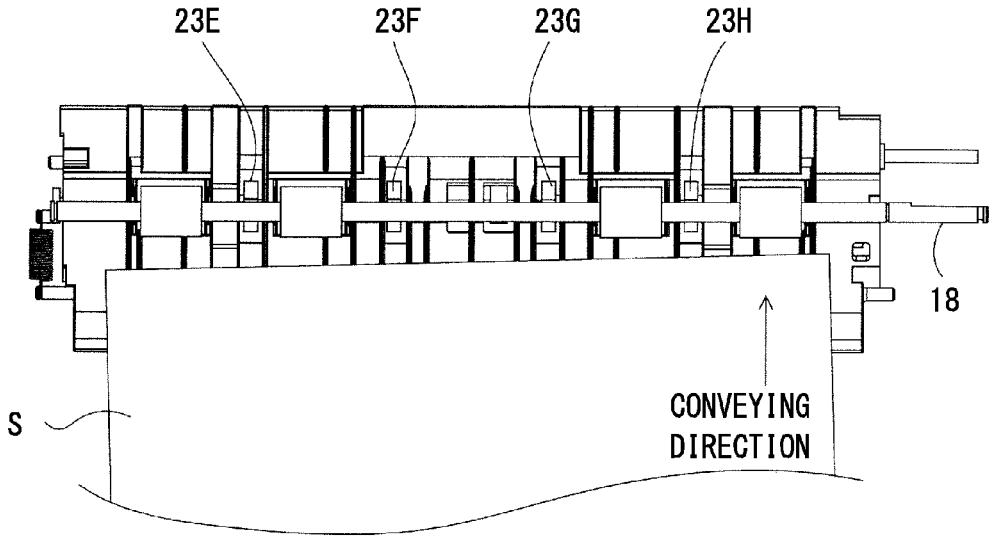
FIG. 12 is a view illustrating a state in which a skewed sheet is conveyed.

FIG. 9 illustrates a state in which the shutter member 23 illustrated in FIG. 8 rotates so that the abutment surface 23*a* retracts from the sheet conveying path 15*a* and the second abutment surface 23*b* stands by at a standby position. FIG. 10 illustrates a state in which the sheet S nipped by the conveying roller pair 18, 19 passes through the nip portion N between the conveying roller pair 18, 19. FIG. 11 illustrates a state in which the sheet S nipped by the conveying roller pair 18, 19 passes through the nip portion N, and the second abutment surface 23*b* is positioned at a home position. In FIGS. 3 to 11, a part of a contact portion between the shutter member 23 and the sheet S is omitted. FIG. 12 illustrates a state in which the skewed sheet S is conveyed.

In a case where there is not a plurality of shutter members 23 fixed to the shutter shaft 22, the sheet S is conveyed with a skewed posture when the sheet S is conveyed by the sheet feeding portion 8 and enters the nip portion N between the conveying roller pairs 18, 19 in a skewed state, for example, as illustrated in FIG. 12. When the sheet S reaches the image forming portion 14 with the skewed posture, the image to be transferred onto the sheet S is recorded onto the sheet S in an inclined manner. However, in this embodiment, the plurality of shutter members 23 fixed to the shutter shaft 22 are configured and arranged as described above, and hence the skew feed of the sheet S is corrected by a function described later, and the image is prevented from being transferred onto the sheet S in an inclined manner with respect to the sheet S. Hereinafter, the operation of the skew feed correcting portion 200 will be described specifically.

First, a preceding leading edge portion of the sheet S (right side in FIG. 12) abuts against the abutment surface 23*a* of the shutter member 23H (see FIG. 12) arranged at a position corresponding to the preceding leading edge portion. At this time, in the shutter member 23, as illustrated in FIG. 3, the abutment surface 23*a* is protruded toward the sheet conveying path 15*a* so that the abutment surface 23*a* stands by at an abutment position where the abutment surface 23*a* can abut against the leading edge of the sheet S. In this state, the sheet S is not in contact with the abutment surface 23*a*, and hence the leading edge of the sheet S is conveyed without being bent.

Next, as illustrated in FIG. 4, when the leading edge of the sheet S abuts against the abutment surface 23*a*, the sheet S receives, as reaction forces, a holding force of the shutter drive member 26 urged by the shutter spring 27, and inertia forces of the plurality of shutter members 23 fixed to the shutter shaft 22 and of the shutter gear 24. At this time, the above-mentioned reaction forces are set so as to be larger than a pressing force of the sheet S, and hence the leading edge of the sheet S cannot rotate the shutter member 23 even if the leading edge presses the shutter member 23 against the reaction forces.

When the sheet feeding portion 8 further conveys the sheet S, the preceding leading edge portion of the sheet S is locked in abutment against the abutment surface 23*a* of the shutter member 23. Then, the succeeding leading edge portions of the sheet S are successively locked in abutment against the abutment surfaces 23*a* of the plurality of shutter members 23 arranged at positions corresponding to the succeeding leading edge portions of the sheet S. That is, the leading edge portions of the sheet S successively abut against the shutter members 23H, 23G, 23F, and 23E of the plurality of shutter members 23.

In this process, as illustrated in FIGS. 5 and 6, the sheet S forms a loop curved in an arrow Y direction in the loop forming portion 32 formed by the guide frame 28 and the feed frame 20 upstream of the conveying roller pair 18, 19. At this time, the right side (illustrated in FIG. 12) of the curved loop of the sheet S is larger than the left side thereof. Due to a series of those operations, the leading edge of the sheet S follows the abutment surfaces 23*a* of the plurality of shutter members 23, and thus becomes parallel to the rotary shaft direction of the conveying roller pair 18, 19. As a result, the skew feed of the sheet S is corrected.

Further, when the sheet S forms a predetermined loop, the pressing force moving the abutment surface 23*a* of the shutter member 23 in a direction (rotation direction) indicated by the arrow Z in FIG. 5 is generated for the first time due to the strength of stiffness of the sheet S against the urging force of the shutter spring 27. Thus, as illustrated in FIG. 6, the plurality of shutter members 23 and the shutter gear 24 further rotate in the direction Z, and the leading edge of the sheet S is nipped by the nip portion N between the conveying roller 19 and the conveying rotatable member 18 in the middle of the rotation. Note that, the shutter drive member 26 connected to the shutter gear 24 rotates in an opposite direction.

Here, the skew feed correction ability of the skew feed correcting portion 200 is more enhanced as the loop formed in the loop forming portion 32 formed by the guide frame 28 and the feed frame 20 is larger. More specifically, as illustrated in FIG. 6, it is desired that a wide loop forming portion 32 be provided. Further, the predetermined loop refers to a loop which pushes up the shutter member 23 when the sheet S forms a loop in the loop forming portion 32 and a part of the loop comes into contact with the guide frame 28 so that the stiffness of the sheet S apparently increases. The sheet S can push up the shutter member 23 when the sheet S forms a loop in the loop forming portion 32 and a part of the loop comes into contact with the guide frame 28 so that the stiffness of the sheet S apparently increases.

As illustrated in FIG. 7, the plurality of shutter members 23, the shutter gear 24, and the shutter drive member 26 are rotated by the sheet S conveyed with a conveying force of the conveying roller pairs 18, 19 against the spring force of the shutter spring 27. FIG. 8 illustrates a state in which the shutter spring 27 extends most (top dead center) on the rotation path of the shutter drive member 26. As illustrated in FIG. 8, when the connection portion 26*c* passes over the top dead center of the shutter spring 27, the plurality of shutter members 23 further rotate in the direction (rotation direction) indicated by the arrow Z of FIG. 8 due to the rotation force generated by the shutter spring 27, instead of the sheet S. Here, as illustrated in FIGS. 9 and 10, the rotation force is generated in the shutter members 23, the rotation force being made by the shutter spring 27 so that the succeeding abutment surface 23*b* attempts to return to the abutment position where the abutment surface 23*b* has a posture of locking the leading edge of the sheet. However, the shutter members 23 cannot rotate any more due to the presence of the sheet S being conveyed in the sheet conveying path. When a trailing edge of the sheet S passes by the shutter member 23, the shutter member 23 rotates to the abutment position together with the shutter gear 24, the shutter drive member 26 and the shutter shaft 22, as illustrated in FIG. 11. Then, the abutment surface 23*b* stands by at the abutment position for aligning the leading edge of the succeeding sheet S.

In this way, the above-mentioned states illustrated in FIGS. 3 to 11 are repeated, whereby the plurality of shutter members 23 fixed to the shutter shaft rotate. When the sheets S are fed successively, the four abutment surfaces change successively from the abutment surface 23*a*, and the respective abutment surfaces abut against (lock) the leading edge of the newly fed sheet S, whereby the skew feed of the sheet S is corrected.

Figure 13:
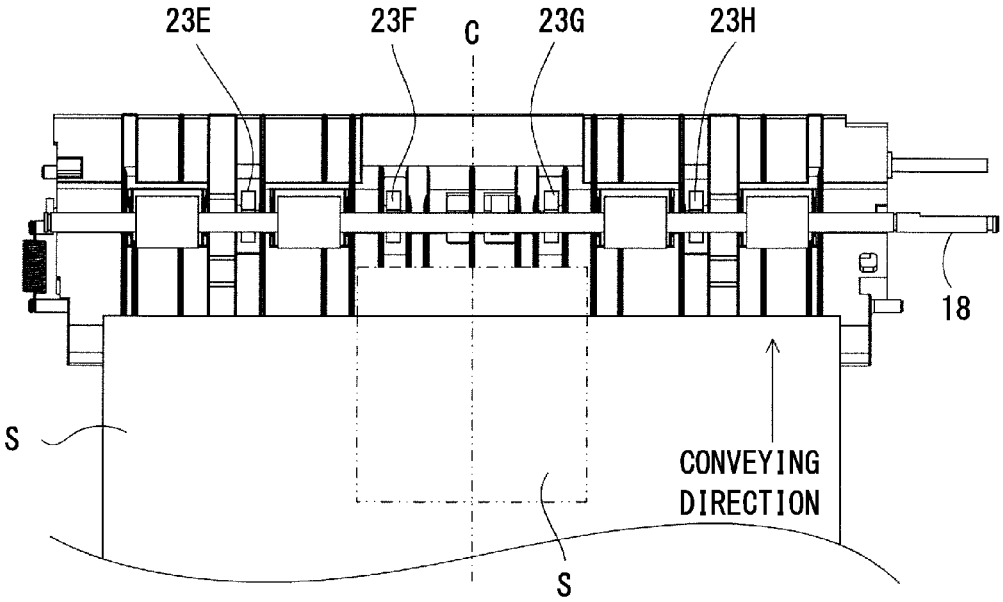
FIG. 13 is a view illustrating a state in which a sheet having a different width is conveyed.

Here, the skew feed correction in cases where the length (hereinafter, referred to as "width of the sheet S") in a direction orthogonal to the sheet conveying direction of the sheet S to be used is relatively large and relatively small will be described with reference to FIG. 13. FIG. 13 illustrates a state in which a sheet having a different sheet width is conveyed.

In the case where the width of the sheet S is relatively large (sheet S indicated by a solid line in FIG. 13), the two shutter members 23E and 23H arranged so as to correspond to vicinities of both side ends of the sheet S mainly act on the leading edge of the sheet S to thereby perform skew feed correction on the sheet S. On the other hand, in the case where the width of the sheet S to be used is relatively small (sheet S indicated by a dotted line in FIG. 13) and does not overlap the shutter members 23E and 23H, the shutter members 23F and 23G arranged in a center portion with respect to the shutter members 23E and 23H perform skew feed correction on the sheet S.

In order to obtain a more accurate skew feed correction ability of the sheet S, the interval between the plurality of shutter members 23 corresponding to the width of the sheet S is preferred to be as wide as possible, and the shutter members 23 is preferred to be arranged substantially symmetrically with respect to the center of the width of the sheet S. The purpose of this is to reduce a correction angle error of the leading edge of the sheet S with respect to the rotary shaft direction of the conveying roller pairs 18, 19. Therefore, the shutter members 23 are arranged in the vicinity of both ends of the sheet S to be conveyed, and it is preferred that the shutter member 23 be also arranged in the vicinity of a conveying center portion C of the sheet S so that even the sheet S having a relatively small width can be subjected to skew feed correction.

Further, at this time, it is preferred that the interval between the two shutter members 23F and 23G on both sides close to the conveying center portion C of the sheet conveying path of the sheet S be set smaller than the minimum width of the sheet S. Further, in this case, it is preferred that the abutment surfaces 23*b* of the shutter members 23F and 23G that abut against the sheet leading edge be arranged slightly downstream of the shutter members 23E and 23H in a sheet conveying direction. In this manner, when the sheet S having a large width is corrected, the shutter members 23F and 23G do not come into contact with the leading edge of the sheet S, and hence the correction angle error can be reduced.

Further, when the distance between the abutment surface 23*b* and the nip portion N between the conveying roller pairs 18, 19 is reduced, the sheet S is conveyed while being nipped by the nip portion N between the conveying roller pairs 18, 19 immediately after the shutter members 23 perform skew feed correction on the sheet S. Therefore, the skew feed correcting effect on the sheet S can be kept.

The image forming apparatus 100 according to the first embodiment having the above-mentioned configuration produces the following effects. In this embodiment, the shutter member 23 can cause the succeeding abutment surface 23*b* to stand by at the abutment position for aligning the leading edge of the sheet S at substantially the same time as the trailing edge of the sheet S is separated from the shutter member 23. With this, the abutment surface 23*b* of the shutter member 23 can return again to the abutment position for aligning the leading edge of the succeeding sheet in a short sheet-to-sheet distance under a condition of a high sheet conveying speed which has been difficult to attain by the conventional technology. As a result, it is possible to respond to the users' demand for further enhancement of a throughput of the sheet conveying apparatus.

Further, conventionally, the shutter member 23 has only one abutment surface, and hence there is a risk that the abutment surface may be abraded depending upon the number of supplied sheets S. However, in this embodiment, such abrasion can be reduced by providing the plurality of abutment surfaces 23*a* to 23*d* to one shutter member 23. Note that, in this embodiment, the abutment surfaces of the shutter member 23 are provided at four places, but a similar effect can be obtained with a configuration in which the abutment surfaces are provided at one to three places depending upon the endurable number of sheets to be supplied to the skew feed correcting portion 200.

Further, in the image forming apparatus 100, the shutter member 23 rotates in one direction, and the abutment surface of the shutter member 23 returns to the abutment position when the urging force of the shutter spring 27 is transmitted to the shutter member 23 from the shutter gear 24 and the shutter drive member 26. Therefore, when the abutment surface is to be positioned at the abutment position for aligning the leading edge of the succeeding sheet, the shutter member 23 does not rotate in a direction opposite to the conveying direction. Thus, the shutter member 23 rotates at a speed substantially equal to the sheet conveying speed and in the same direction as the sheet conveying direction, whereby the abutment surface can return to the stand-by position. As a result, the skew feed correction can be reliably performed even in a short sheet-to-sheet distance in an apparatus with a high sheet conveying speed. Further, a mechanism for mechanically performing skew feed correction on the sheet in the same way as in the conventional example can be produced with a simple configuration at low cost. As a result, space can be saved, and the skew feed correction ability can be reliably exerted.

Second Embodiment

Next, an image forming apparatus 100A according to a second embodiment of the present invention will be described with reference to FIGS. 14A to 16B together with FIG. 1. The image forming apparatus 100A according to the second embodiment is different from the image forming apparatus 100 of the first embodiment in that a detection sensor portion 30 which detects the rotation position of the shutter member 23 is provided in a skew feed correcting portion 200A. Therefore, in the second embodiment, the point different from the first embodiment, that is, the detection sensor potion 30 which detects the rotation position of the shutter member 23 will be mainly described. Note that, in the second embodiment, the same components as those of the image forming apparatus 100 according to the first embodiment are denoted by the same reference symbols, and the descriptions thereof are omitted. In the second embodiment, the same components as those of the first embodiment produce the same effects as those of the first embodiment.

Figure 14A:
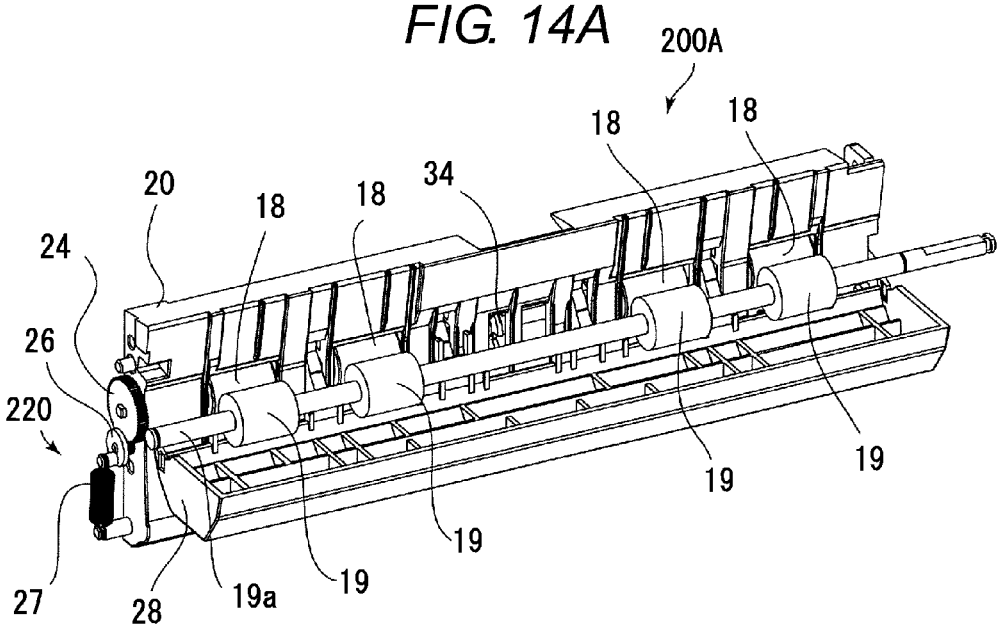
FIG. 14A is a perspective view of a skew feed correcting portion according to a second embodiment of the present invention.
Figure 14B:
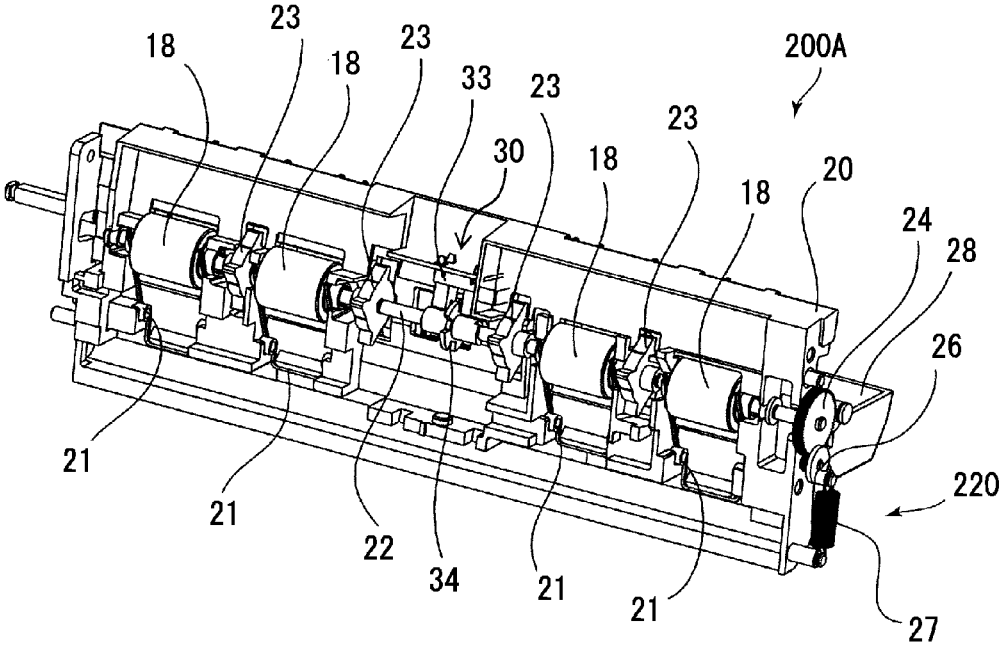
FIG. 14B is a perspective view of the skew feed correcting portion illustrated in FIG. 14A, when viewed from an opposite side of FIG. 14A.

First, an entire structure of the image forming apparatus 100A according to the second embodiment will be described with reference to FIGS. 14A and 14B together with FIG. 1. FIG. 14A is a perspective view of the skew feed correcting portion 200A according to the second embodiment. FIG. 14B is a perspective view of the skew feed correcting portion 200A illustrated in FIG. 14A, when viewed from an opposite side of FIG. 14A.

As illustrated in FIG. 1, the image forming apparatus 100A includes the sheet feeding portion 8, the image forming portion 14, the fixing portion 10, a sheet conveying portion 9A serving as a sheet conveying apparatus, and the sheet delivery portion 13. The sheet conveying portion 9A includes the sheet conveying path 15*a*, the duplex conveying path 15*b*, the oblique-feed roller pair 16, the U-turn roller pair 17, the plurality of roller pairs 18, 19, and the skew feed correcting portion 200A. As illustrated in FIGS. 14A and 14B, the skew feed correcting portion 200A includes the feed frame 20, the guide frame 28, shutter members 23, and the detection sensor portion 30.

The detection sensor portion 30 includes a detection sensor 33 and a sheet detecting member 34. The detection sensor 33 is an optical sensor (for example, a photosensor) forming an optical path L with a light-emitting element and a light-receiving element, and is mounted to the feed frame 20. The detection sensor 33 is arranged in a rotation path of the sheet detecting member 34, and detects that the detection sensor 33 has rotated to a predetermined rotation position when the sheet detecting member 34 blocks the optical path L.

The sheet detecting member 34 is fixed to the shutter shaft 22 with a spring pin (not shown) and rotates integrally with the shutter shaft 22 and the shutter members 23. That is, the sheet detecting member 34 is coaxially arranged with the shutter members 23 and rotates integrally with the shutter members 23. Further, the sheet detecting member 34 includes a plurality of detection surfaces 33*a*, 33*b*, 33*c*, and 33*d* formed in the peripheral direction thereof. The plurality of the detection surfaces 33*a*, 33*b*, 33*c*, and 33*d* successively block the optical path L of the detection sensor 33 by the rotation of the sheet detecting member 34.

The skew feed correcting portion 200A corrects the skew feed of the sheet S with the shutter members 23 and detects the leading edge position of the sheet S when the sheet detecting member 34 that rotates together with the shutter members 23 blocks light to be received by the detection sensor 33. Then, after the skew feed correcting portion 200A detects the leading edge position of the sheet S, the image forming apparatus 100A according to the second embodiment allows the image forming portion 14 to start forming an image.

Figure 15A:
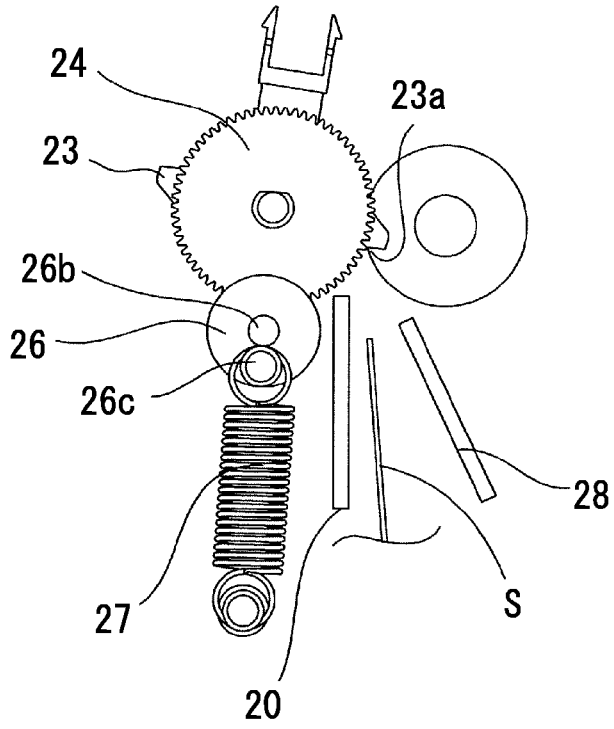
FIG. 15A is a view illustrating a state in which a sheet is conveyed to the skew feed correcting portion according to the second embodiment.
Figure 15B:
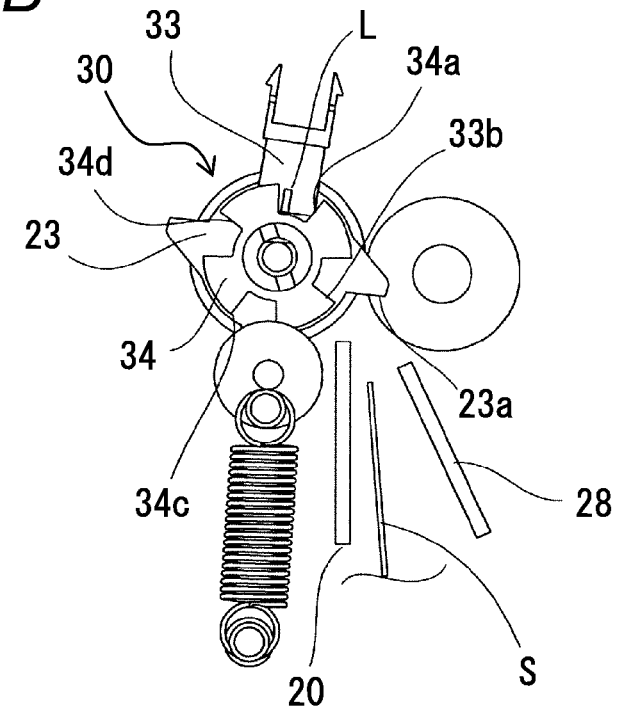
FIG. 15B is a view illustrating a detection sensor portion in the state illustrated in FIG. 15A.
Figure 16A:
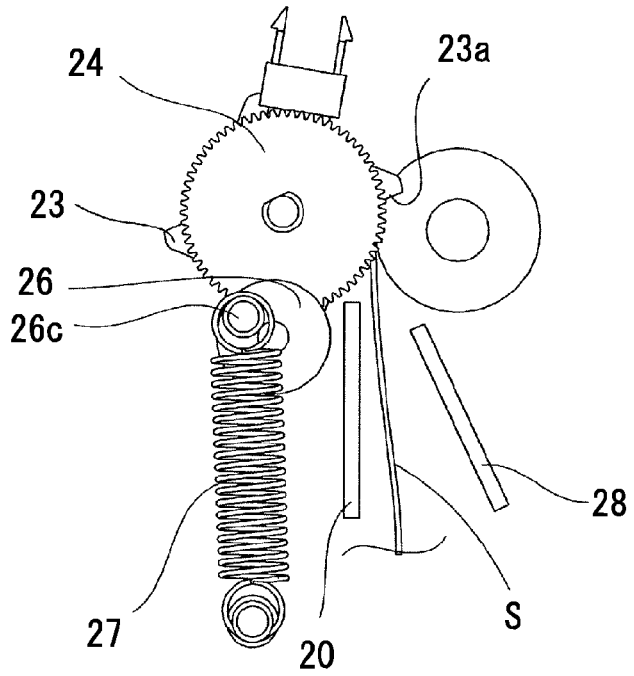
FIG. 16A is a view illustrating a state in which the leading edge of the sheet presses an abutment surface of a shutter member illustrated in FIG. 14A so that the shutter member rotates.
Figure 16B:
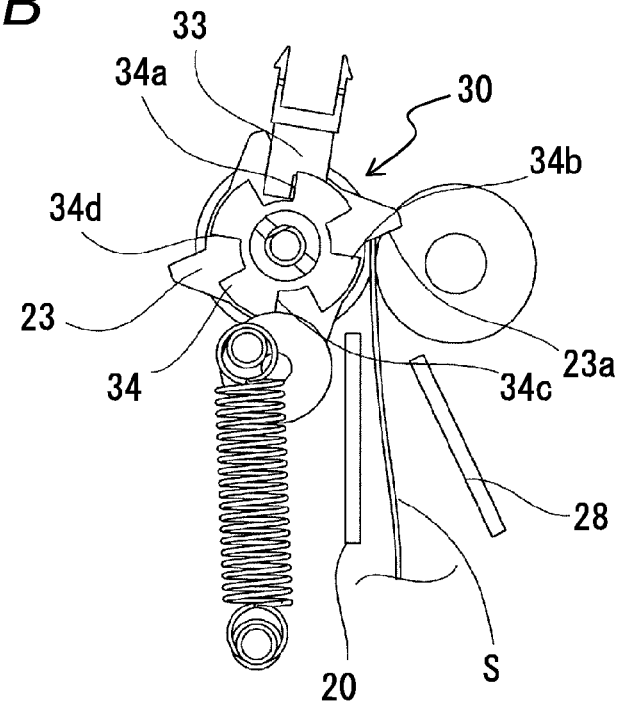
FIG. 16B is a view illustrating a detection sensor portion in the state illustrated in FIG. 16A.
Figure 17:
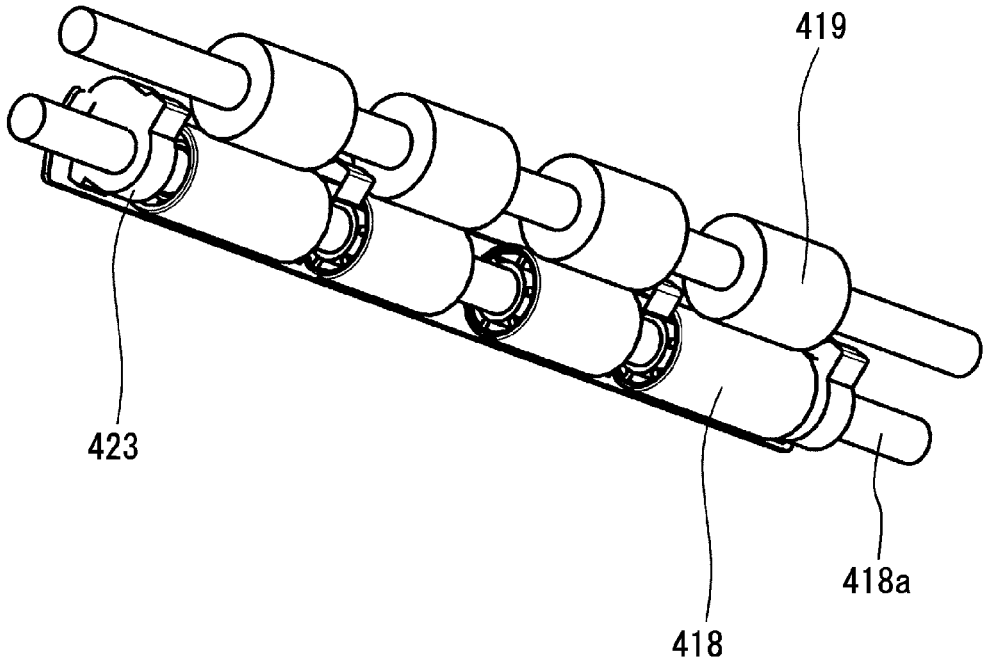
FIG. 17 is a perspective view illustrating a skew feed correcting portion according to a conventional example of an image forming apparatus.
Figure 18A:
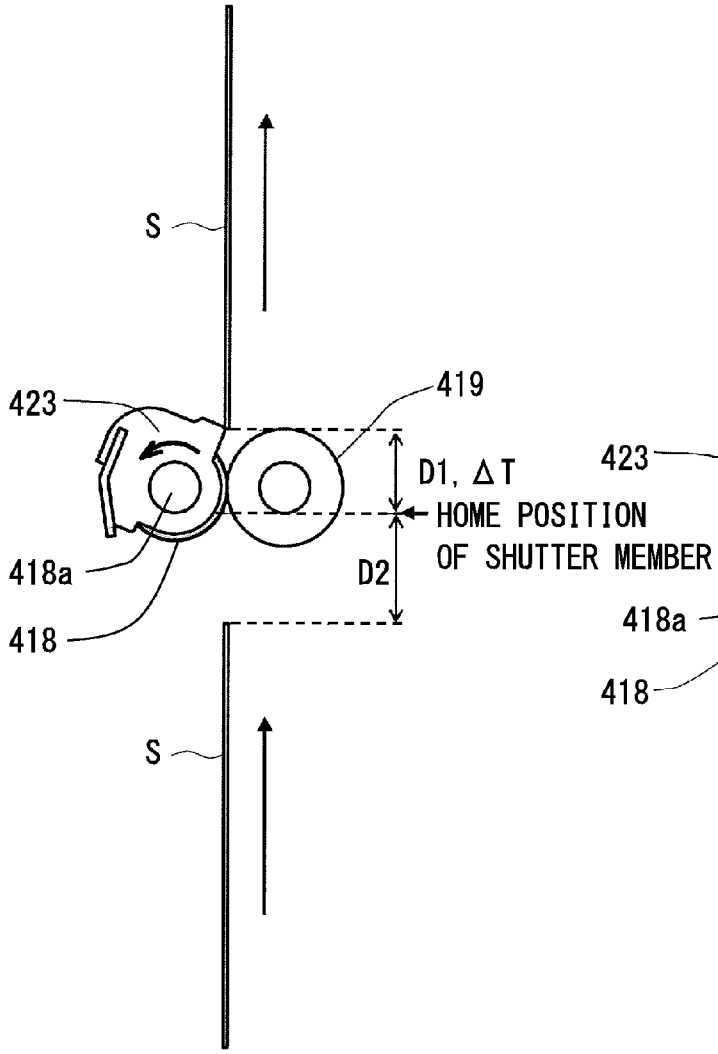
FIG. 18A is a view illustrating a state in which the leading edge of the sheet abuts against the shutter member of the skew feed correcting portion illustrated in FIG. 16B, and the shutter member rotates.
Figure 18B:
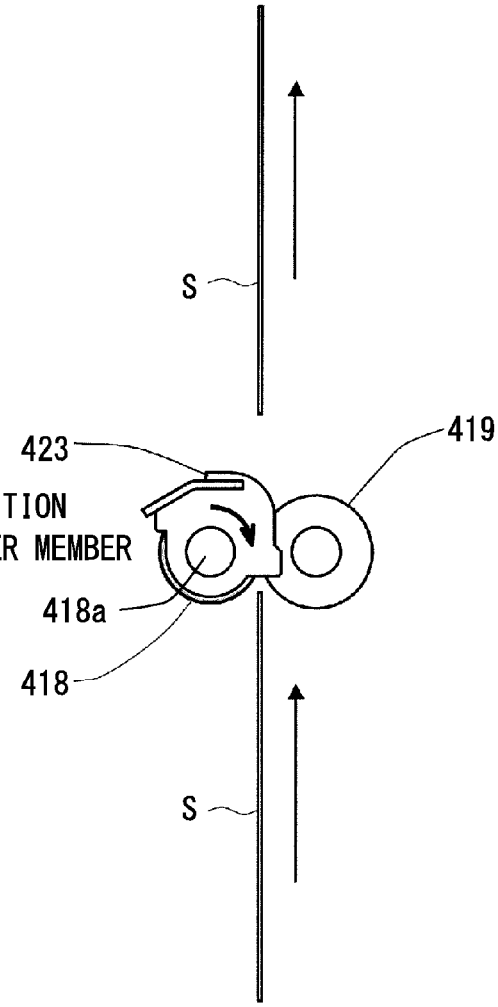
FIG. 18B is a view illustrating a state in which the sheet passes and the shutter member returns to a standby position.

Next, the operation of the skew feed correcting portion 200A will be described with reference to FIGS. 15A to 16B. FIG. 15A illustrates a state in which the sheet S is conveyed to the skew feed correcting portion 200A according to the second embodiment. FIG. 15B is a view illustrating the detection sensor portion 30 in the state illustrated in FIG. 15A. FIG. 16A illustrates a state in which the leading edge of the sheet S presses the abutment surface 23*a* of the shutter member 23 illustrated in FIG. 15A so that the shutter member 23 rotates. FIG. 16B is a view illustrating the detection sensor portion 30 in the state illustrated in FIG. 16A.

As illustrated in FIG. 15A, before the leading edge of the sheet S comes into contact with the abutment surface 23*a* of the shutter member 23, the shutter spring 27 and the shutter drive member 26 are at a stop in a balanced state, and the abutment surface 23*a* of the shutter member stands by at the abutment position for detecting the leading edge of the sheet S. At this time, as illustrated in FIG. 15B, the optical path L of the detection sensor 33 is not blocked by the sheet detecting member 34 and is in a transmitted state.

Next, when the leading edge of the sheet S comes into contact with the abutment surface 23*a*, and then, the shutter members 23 rotate and the sheet S is nipped and conveyed by the conveying roller pairs 18, 19, the sheet detecting member 34 blocks the optical path L of the detection sensor 33, as illustrated in FIG. 16B. When the sheet detecting member 34 blocks the optical path L of the detection sensor 33, the detection sensor 33 determines that the leading edge of the sheet S has reached a desired position and transmits a predetermined detection signal to the image forming portion 14. Then, when the image forming portion 14 receives the detection signal, the image forming portion 14 starts forming an image.

After that, the shutter spring 27, the shutter members 23, and the shutter gear 24 perform the operations similar to those of the first embodiment. Further, the sheet detecting member 34 rotates and operates in a similar manner to that of the shutter members 23 according to the first embodiment, and when the trailing edge of the sheet S passes through the abutment position, the succeeding detection surface 34*b* upstream of the detection surface 34*a* stands by again at the stand-by position for detecting the leading edge of the succeeding sheet S. Then, when the sheet S is fed successively, the detection surfaces of the sheet detecting member 34 change successively from the detection surface 34*a* to the detection surfaces 34*b*, 34*c*, and 34*d*. The respective detection surfaces detect the leading edge of the newly fed sheet S, and an image is formed successively based on that signal.

The image forming apparatus 100A according to the second embodiment having the above-mentioned configuration produces the following effect in addition to the effect obtained from the configuration similar to that of the first embodiment. The skew feed correcting portion 200A according to the second embodiment includes the detection sensor 33 and the sheet detecting member 34 that rotates integrally with the shutter members 23. Therefore, the skew feed correcting portion 200A can perform detection of the leading edge position of the sheet S in addition to the skew feed correction of the sheet S by the shutter members 23. Thus, the image forming apparatus 100A can synchronize the timing for forming an image by the image forming portion 14 in association with the rotating operation of the shutter members 23. As a result, the image forming apparatus 100A does not need to separately include a sheet detecting portion which detects the leading edge position of the sheet S, which can reduce production cost.

Further, the sheet detecting member 34 performs the operation similar to that of the shutter members 23 of the first embodiment. Therefore, the sheet detecting member 34 can stand by at a home position (abutment position of an abutment surface) for detecting the leading edge of the succeeding sheet S at almost the same time that the trailing edge of the sheet S is separated from the shutter member 23. Thus, the sheet detecting member 34 can return to the home position for detecting the leading edge of the succeeding sheet S even in the short sheet-to-sheet distance under the condition of the high sheet conveying speed, and it is possible to respond to the users' demand for further enhancement of a throughput of the sheet conveying apparatus.

Although the embodiments of the present invention are described above, the present invention is not limited to the above-mentioned embodiments. Further, the effects described in the embodiments of the present invention are the most preferred effects obtained from the present invention, and the effects of the present invention are not limited to those described in the embodiments of the present invention.

In the embodiments, the first rotary member and the second rotary member are connected to each other by engaging the gears thereof, but the present invention is not limited thereto. For example, the first rotary member and the second rotary member may be connected to each other through a timing belt so as to increase the speed of the rotation (one turn with respect to ¼ turn) of the shutter drive member 26.

Further, in the embodiments, four abutment surfaces are provided at the shutter member 23, but the present invention is not limited thereto. The number of the abutment surfaces may be set as follows: the gear ratio of the second rotary member to the first rotary member is set with an integer ratio of the same number as the number of the abutment surfaces, and the second rotary member is rotated by switching the abutment surfaces.

Further, in the embodiments, the urging force for positioning the abutment surfaces of the shutter members 23 at the abutment position is generated by the shutter spring 27, but the present invention is not limited thereto. For example, the shutter members 23 may allow the abutment surfaces to stand by at the abutment position due to the gravity by adjusting the weight balance of the shutter drive member 26.

Further, in the first embodiment, the plurality of shutter members 23 and the shutter gear 24 are fixed to the shutter shaft 22, but the present invention is not limited thereto. For example, the plurality of shutter members 23, the shutter gear 24, and the shutter shaft 22 may be formed integrally.

Further, in the second embodiment, the sheet detecting member 34 is arranged independently, but the present invention is not limited thereto. For example, the sheet detecting member 34 may be formed integrally with the shutter gear 24 or the shutter members 23.

Further, in the second embodiment, the sheet detecting member 34 and the detection sensor 33 are used to detect the sheet S, and an image is formed in synchronization with the sheet S based on that signal, but the present invention is not limited thereto. For example, an image may be formed in advance, and the position of the sheet S may be adjusted to the image when the detection sensor 33 detects the sheet S, or only the conveyance delay of the sheet S, the paper jam, etc., may be detected.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-058347, filed Mar. 16, 2011, which is hereby incorporated by reference herein in its entirety.

What is claimed is:

1. A sheet conveying apparatus, comprising:

a first conveying portion which conveys a sheet;

a second conveying portion provided downstream of the first conveying portion which conveys the sheet conveyed by the first conveying portion;

a shutter member which rotates by being pressed by the conveyed sheet and includes a plurality of abutment surfaces against which a leading edge of the sheet conveyed by the first conveying portion abuts, the plurality of abutment surfaces being formed in a peripheral direction of the shutter member;

a shaft connected to the shutter member to rotatably support the shutter member;

a first rotary member connected to the shaft;

a second rotary member connected to the first rotary member; and a biasing portion connected to a part of the second rotary member located offset with respect to a rotation center of the second rotary member to hold the second rotary member at a predetermined position and to position one abutment surface of the plurality of abutment surfaces upstream of the second conveying portion, wherein the second rotary member rotates at a speed ratio of the second rotary member to the first rotary member when the first rotary member rotates, the speed ratio being the same number as a number of the plurality of abutment surfaces.

2. A sheet conveying apparatus according to claim 1, the biasing portion is an elastic member having one end positionally-fixed and another end connected to the second rotary member.

3. A sheet conveying apparatus according to claim 1, wherein the biasing portion is a spring having one end positionally-fixed and another end connected to the second rotary member.

4. A sheet conveying apparatus according to claim 1, wherein the biasing portion holds the shutter member at a position at which the leading edge of the sheet conveyed by the first conveying portion abuts against one abutment surface of the plurality of abutment surfaces.

5. A sheet conveying apparatus according to claim 1, wherein the second conveying portion is positioned to nip the sheet when the leading edge of the sheet conveyed by the first conveying portion abuts against one abutment surface of the plurality of abutment surfaces of the shutter member.

6. An image forming apparatus, comprising:

a sheet conveying apparatus as recited in claim 1; and an image forming portion which forms an image on a sheet conveyed by the sheet conveying apparatus.

* * * * *